US009982575B2

(12) United States Patent
Weber

(10) Patent No.: US 9,982,575 B2
(45) Date of Patent: May 29, 2018

(54) HYDRAULIC CAMSHAFT ADJUSTER, AT LEAST TWO-PART ROTOR, AND METHOD FOR PRODUCING A ROTOR OF A HYDRAULIC CAMSHAFT ADJUSTER

(71) Applicant: SCHAEFFLER TECHNOLOGIES AG & CO. KG, Herzogenaurach (DE)

(72) Inventor: Juergen Weber, Erlangen (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days. days.

(21) Appl. No.: 15/122,644

(22) PCT Filed: Feb. 16, 2015

(86) PCT No.: PCT/DE2015/200080
§ 371 (c)(1),
(2) Date: Aug. 31, 2016

(87) PCT Pub. No.: WO2015/139695
PCT Pub. Date: Sep. 24, 2015

(65) Prior Publication Data

US 2017/0067376 A1 Mar. 9, 2017

(30) Foreign Application Priority Data

Mar. 20, 2014 (DE) ..... 10 2014 205 237

(51) Int. Cl.
*F01L 1/34* (2006.01)
*F01L 1/344* (2006.01)
(Continued)

(52) U.S. Cl.
CPC ..... *F01L 1/3442* (2013.01); *B22F 3/1017* (2013.01); *B22F 3/16* (2013.01);
(Continued)

(58) Field of Classification Search
CPC . F01L 1/3442; F01L 1/46; F01L 1/047; F01L 2103/01; F01L 2001/34479;
(Continued)

(56) References Cited

U.S. PATENT DOCUMENTS 8,550,046 B2 10/2013 Terfloth et al.
2013/0186356 A1 7/2013 Shelter

FOREIGN PATENT DOCUMENTS

DE 102008028640 A1 12/2009
DE 102009053600 A1 5/2011
(Continued)

OTHER PUBLICATIONS

English Abstract of JP 60155605A listed above, Aug. 1985.*
International Search Report for International Application No. PCT/DE2015/200080 dated Apr. 29, 2015.

*Primary Examiner* — Zelalem Eshete
(74) *Attorney, Agent, or Firm* — Brooks Kushman P.C.

(57) ABSTRACT

A hydraulic camshaft adjuster includes an at least two-part rotor which can be rotated about an axis and comprises a first rotor element and a second rotor element. The first rotor element has at least one first bore, which is aligned with at least one second bore of the second rotor element. A connecting element sits in the at least one first bore and the at least one second bore such that the first rotor element is connected to the second rotor element in a positive-locking, frictional, and/or bonded manner. An at least two-part rotor of a hydraulic camshaft adjuster is also provided, and a method for producing a rotor of a hydraulic camshaft adjuster.

14 Claims, 3 Drawing Sheets

(51) Int. Cl.

| | |
|---|---|
| ***F01L 1/46*** | (2006.01) |
| ***B22F 3/10*** | (2006.01) |
| ***B22F 3/16*** | (2006.01) |
| ***B22F 5/00*** | (2006.01) |
| ***F01L 1/047*** | (2006.01) |

(52) U.S. Cl.
CPC ..... *B22F 5/00* (2013.01); *F01L 1/047* (2013.01); *F01L 1/46* (2013.01); *F01L 2001/34479* (2013.01); *F01L 2101/00* (2013.01); *F01L 2103/00* (2013.01); *F01L 2103/01* (2013.01)

(58) Field of Classification Search
CPC ..... F01L 2101/00; B22F 3/1017; B22F 3/16; B22F 5/00
See application file for complete search history.

(56) References Cited

FOREIGN PATENT DOCUMENTS

| | | | | |
|---|---|---|---|---|
| DE | 102011117856 | A1 | | 5/2013 |
| EP | 1731722 | B1 | | 12/2008 |
| EP | 2300693 | B1 | | 8/2012 |
| JP | 60155605 | A | * | 8/1985 |
| WO | 2012152235 | A1 | | 11/2012 |

* cited by examiner

HYDRAULIC CAMSHAFT ADJUSTER, AT LEAST TWO-PART ROTOR, AND METHOD FOR PRODUCING A ROTOR OF A HYDRAULIC CAMSHAFT ADJUSTER

CROSS-REFERENCE TO RELATED APPLICATIONS

This application is the U.S. National Phase of PCT Appln. No. PCT/DE2015/200080 filed Feb. 16, 2015, which claims priority to DE 10 2014 205 237.8 filed Mar. 20, 2014, the entire disclosures of which are incorporated by reference herein.

TECHNICAL FIELD

The present disclosure relates to a hydraulic camshaft adjuster having an at least two-piece rotor. The at least two-piece rotor can rotate about an axis, and is composed of a first rotor element and a second rotor element.

The present disclosure also relates to an at least two-piece rotor for a hydraulic camshaft adjuster.

The disclosure furthermore relates to a method for the production of a rotor for a hydraulic camshaft adjuster.

BACKGROUND

It is generally known that camshaft adjusters enable optimal valve control times over a broad load and rotational rate range for a motor. In this manner, significant reductions in emissions and fuel consumption have been achieved. Furthermore, by optimizing the torque and the performance, the driving enjoyment is increased significantly. A distinction is made in the prior art between electric camshaft adjusters and the hydraulic camshaft adjusters specified in the introduction.

Rotors are known from the field of hydraulic camshaft adjusters, which are composed of a first rotor element and a second rotor element. This is disclosed, for example, in the German patent application DE 10 2009 053 600 A1. Two rotor elements are connected with pins or sintered therein. The disadvantage with this is that additional connecting parts such as pins are required. As a result, there are additional costs for parts and installation.

Another embodiment for joining two rotor elements of a rotor is described in the German patent application DE 10 2008 028 640 A1. Two rotor elements are designed therein, such that they can be joined due to their respective "distinct" geometries. Two rotor elements that seal oil channels through sinter facets, and are thus connected to one another, is disclosed in the German patent application DE 10 2011 117 856 A1. The European patent application EP 2 300 693 B1 furthermore describes two identical rotor elements, joined by means of a form fit and press fit to form the oil channels. In the documents specified in this paragraph, the form-fitting and sealing elements extend beyond sealing surfaces, and can be produced either by additional separating planes in the sintering tool or by an excess pressure applied to the entire surface of the flange on the rotor elements. The negative consequences here are the additional tool costs, larger pressing machines and a reduction in quality of the sealing surfaces in the interstice subjected to excess pressure, e.g. the degradation of the evenness and parallel alignment of the end surfaces of the rotor, and an increase in the internal leakage between the oil channels as a result of irregularities in the interstice.

The rotor designed in the form of a composite system, wherein the rotor core plus the cover form the oil channels, is disclosed in the European patent application EP 1 731 722 B1. The separating plane is not in the sintered part thereby, because the complete width of the rotor is produced using sintering technology, as is the case with the single-piece rotors known from the prior art. As a result, it is not possible to obtain a cost reduction in relation to a single-piece rotor, because a larger compression machine having a higher pressure force must be used, as is the case with a single-piece rotor. A cost reduction first obtained by reducing the width of the rotor, e.g. by means of the division of the rotor described in the introduction, can be realized as a result of lower cost factors for the smaller compression machine.

One objective of the present disclosure is thus to further develop a hydraulic camshaft adjuster, having an at least two-piece rotor, such that it is constructed in a cost-effective manner, with higher quality, and is furthermore functionally reliable when in operation.

This objective is achieved by means of a hydraulic camshaft adjuster having an at least two-piece rotor, comprising the features described herein.

Another objective of the present disclosure is to create an at least two-piece rotor for a hydraulic camshaft adjustor, that is produced simply and economically.

This objective is achieved by means of an at least two-piece rotor for a hydraulic camshaft adjuster comprising the features of described herein.

Another objective of the present disclosure is to provide a simple, quality-improving and economical method for producing a rotor for a hydraulic camshaft adjuster.

This objective is achieved by means of a method for producing a rotor for a hydraulic camshaft adjuster comprising the features described herein.

SUMMARY

With the hydraulic camshaft adjuster according to the disclosure, having an at least two-piece rotor, which can rotate about an axis and is composed of a first rotor element and a second rotor element, the first rotor element has at least one first bore-hole, which is aligned with at least one second bore-hole of the second rotor element. A joinable connecting element is located thereby in the at least one first bore-hole and the at least one second bore-hole, such that the first rotor element is connected to the second rotor element in a form-fitting, force-fitting and/or material bonded manner. The first rotor element and the second rotor element may be connected to one another via four connecting elements, such that the first rotor element therefore has four first bore-holes, and the second rotor element has four second bore-holes. As a matter of course, other embodiments, having more or fewer connecting elements, first bore-holes and second bore-holes, are also conceivable.

In a first embodiment of the hydraulic camshaft adjuster according to the present disclosure, a first free end of the joinable connecting element is secured in place by means of a sintered connection or a laser-welded seam on a bore-hole wall of the at least first bore-hole and/or a second free end of the joinable connecting element is secured in place by means of a sintered connection or laser-welded seam on a bore-hole wall of the at least second bore-hole.

In another embodiment of the present disclosure, the joinable connecting element is a powder column or a sintering core. The advantages of the connecting element in the form of a powder column or a sintering core shall be described below in reference to the method according to the present disclosure for producing a rotor for a hydraulic camshaft adjuster.

Another embodiment of the hydraulic camshaft adjuster according to the present disclosure provides that the first rotor element and the second rotor element of the at least two-piece rotor has numerous blades, each of which have the at least first bore-hole, or the at least second bore-hole, formed therein, and in each case a joinable connecting element extends from the first bore-hole into the second bore-hole. In this embodiment as well, the first rotor element and the second rotor element are connected to one another via four connecting elements.

It should furthermore be noted that the at least two-piece rotor can also be designed such that the same connecting technology, i.e. a joinable connecting element in at least a first and second bore-hole, can also be used for other parts of the hydraulic camshaft adjuster according to the present disclosure, e.g. in the stator.

With the at least two-piece rotor for a hydraulic camshaft adjuster according to the present disclosure, a first rotor element has, according to the present disclosure, at least a first bore-hole, and a second rotor element has, according to the present disclosure, at least a second bore-hole, wherein a powder column or a sintering core is pressed and/or sintered into the at least first bore-hole or the at least second bore-hole. Advantageously, the powder column or the sintering core is pressed into and/or sintered to a bore-hole end or the middle of a bore-hole, i.e. a blind bore-hole, or optionally, two separate, opposing, coaxial blind bore-holes, is/are formed.

The method for producing a rotor for a hydraulic camshaft adjuster is distinguished according to the present disclosure by the following steps: in a first step, at least one first bore-hole in a first rotor element and at least one second bore-hole in a second rotor element can be formed by means of sintering, or optionally, drilled. It should be ensured thereby that a diameter of the at least second bore-hole, which is can be produced by means of a sintering shaping process, is the same as, or slightly smaller than, a diameter of the at least first bore-hole. The nominal diameter thereof is 2.0 to 5 mm in one embodiment.

In a subsequent step, a connecting element is formed at an end or in the middle of the at least first bore-hole. If a connecting element is formed at the end of the bore-hole, then the first rotor element has a blind bore-hole. If a connecting element is formed in the middle of the bore-hole, then the first rotor element has two separate, coaxially opposing blind bore-holes.

A subsequent step provides that the first rotor element and the second rotor element are place on top of one another, such that the at least first bore-hole is aligned with the at least second bore-hole.

In a further step, the joinable connecting element is axially sheared off from a bore-hole wall of the at least first bore-hole by means of a pressing element, such that the joinable connecting element is at least partially joined into the at least second bore-hole. In particular, the joining of the joinable connecting element occurs by means of a longitudinal press-fit into the at least second bore-hole, by means of a pressure mandrel for example. The joinable connecting element may be inserted halfway thereby, in terms of its axial length, into the at least second bore-hole, i.e. the connecting element is placed between the at least first and at least second rotor elements. The length of the sheared off and joined connecting element is 3 to 20 mm in an embodiment, depending on the thickness of the assembled, at least two-piece rotor.

The joined rotor is subsequently sintered and calibrated. Alternatively, already pre-sintered rotor parts can be joined to one another in an assembly tool by means of shear-joining, and calibrated in the same tool.

As a result, two different sequences with respect to the sintering and calibration procedures can be used in the production of the rotor. In brief, these are: the first embodiment provides that the two rotor elements, including their bore-holes, are pressed from sintering powder, subsequently both rotor elements are joined by means of shear-joining, and subsequently sintered and calibrated. The alternative embodiment provides that, likewise, the two rotor elements, including their bore-holes, are pressed from sintering powder, subsequently already sintered, however, and then joined by means of a shear-joining (optionally here, sintering core laser-welding), and subsequently calibrated.

It should be noted at this point that the calibration of the sintered part comprises locally repressing sintered surfaces having sintering pores, with the aim of evening out the distortions in the sintering process, thus to increase the dimensional precision and also the surface density, surface hardness, surface quality of the relevant functional surfaces or functional elements, as well as the durability of the component, such that this step can be used here. The repressing can be increased depending on the pore density and pore size in the starting material, the compressing process (shaping in a compression mold or rollers) and the deformation degree of up to 100% of the possible packing density. As a result, the calibrated surfaces are nearly poreless, and the material density in the surface region is nearly identical to the density of the solid base material (e.g. steel, at ca. 7.8 g/cm$^3$).

The method according to the present disclosure thus connects the first and the second rotor elements by means of an interstice and shear-joint. This interstice and shear joint technology can be used, in particular, for sintered steel, steel, sintered aluminum, aluminum, or plastic parts, such that this type of connection is suitable for use not only for the rotor parts of the camshaft adjuster, but also for other parts, such as those in the stator or in the blade region of the camshaft adjuster. As a result, a rotor can be connected multiple times in a method step with this technology in the base body as well as in the blade region.

In an embodiment of the method according to the present disclosure, the formation of the joinable connecting element is carried out by means of a compression technology or sintering technology, such that a powder column or a sintering core is pressed into and/or sintered in the at least one first bore-hole.

In another embodiment of the method according to the present disclosure, a first free end and a second free end of the joinable connecting element is clamped, optionally by means of a compression device, and then axially sheared off by means of the pressing element. In this manner, a better separation of the joinable connecting element from the bore-hole wall is obtained. In addition, material blow-outs on the sheared surfaces are avoided.

In another optional embodiment of the method according to the present disclosure, the first free end of the joinable connecting element is secured in place, by means of a sintering technology connection or laser-welding seams, to the bore-hole wall of the at least first bore-hole and/or the second free end of the joinable connecting element is secured in place, by means of a sintering technology connection or laser-welding seams, to a bore-hole wall of the at least second bore-hole.

Directly after the assembly, an outer casing of the assembled rotor is calibrated, potentially in the same joining tool, i.e. the pressing element, or in the compression device, in order to close the interstice, seal oil channels, and to obtain the necessary tolerance precision on an axial and/or radial bearing, as well as on other functional surfaces such as locking bore-holes, etc.

One advantage of the present disclosure is that with the method and under the aspect of "the interstice and shear-joint," both rotor elements are joined to one another through a combination of form-fitting, force-fitting and/or material bonding. The result thereby is a simple and economical hydraulic camshaft adjuster, having an at least two-piece rotor, which also results in there no longer being any leakage of oil during operation (the connecting element is located in bore-holes).

BRIEF DESCRIPTION OF THE DRAWINGS

Exemplary embodiments of the present disclosure and the advantages thereof shall be explained in greater detail below, with reference to the attached Figures. The proportions in the figures do not always correspond to the actual proportions, because some shapes are simplified, and other shapes are enlarged for the sake of a better illustration, in relation other elements.

DETAILED DESCRIPTION

Identical reference symbols are used for identical elements, or elements having the same function. Furthermore, for purposes of clarity, only those reference symbols that are necessary for the description of the respective Figure are depicted in the individual Figures. The depicted embodiments only represent examples of how the hydraulic camshaft adjuster according to the present disclosure, the at least two-piece rotor for a hydraulic camshaft adjuster, and the method according to the present disclosure for producing a rotor for a hydraulic camshaft adjuster, could be designed, and thus do not represent a closed delimiting of the present disclosure.

Figure 1A:
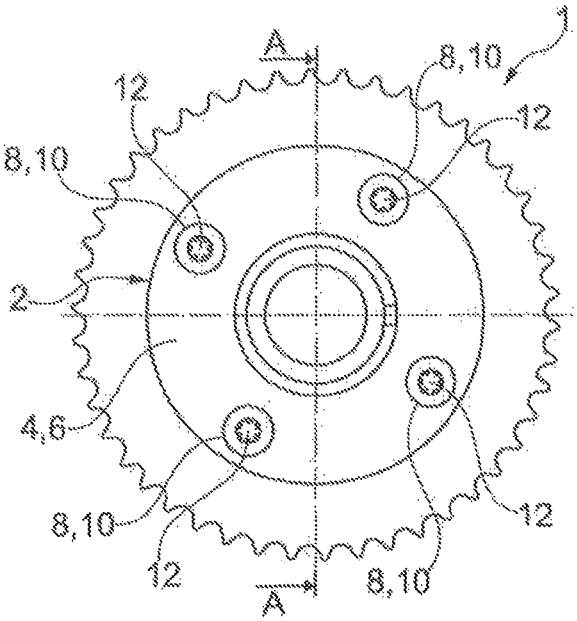
FIGS. 1A and 1B show a top view and a sectional view along line A-A from FIG. 1A of an embodiment of the hydraulic camshaft adjuster according to the present disclosure, having an at least two-piece rotor.
Figure 1B:
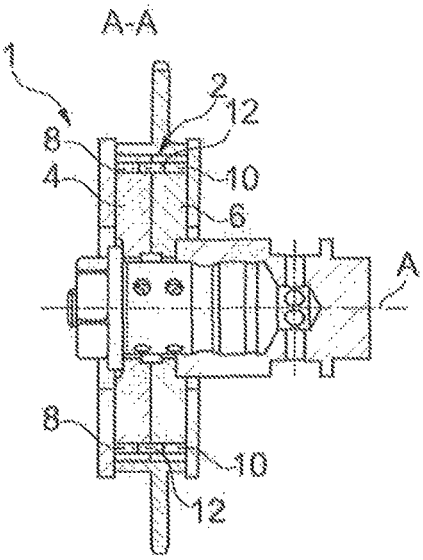

FIG. 1A shows a top view, and FIG. 1B shows a sectional view along the line A-A from FIG. 1A, of an embodiment of the hydraulic camshaft adjuster 1 according to the present disclosure, having an at least two-piece rotor 2, which can rotate about an axis A. The rotor 2 is composed of a first rotor element 4 and a second rotor element 6.

According to the present disclosure, the first rotor element 4 has four first bore-holes 8, which are aligned with four second bore-holes 10 of the second rotor element 6. A joinable connecting element 12, such as a powder column or a sintering core 12, is located thereby in each first bore-hole 8 and second bore-hole 10, such that the first rotor element 4 is connected to the second rotor element 6 in a form-fitting, force-fitting and/or material bonded manner. As a matter of course, it is also conceivable that the first rotor element 4 is connected to the second rotor element 6 using more or fewer than four connecting elements 12.

Figure 2A:
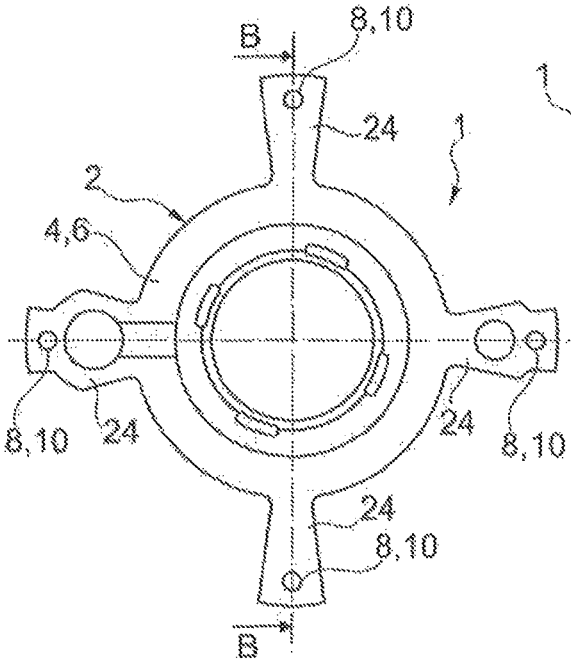
FIGS. 2A and 2B show a top view and a sectional view along the line B-B from FIG. 2A of another embodiment of the hydraulic camshaft adjuster according to the present disclosure, having an at least two-piece rotor.
Figure 2B:
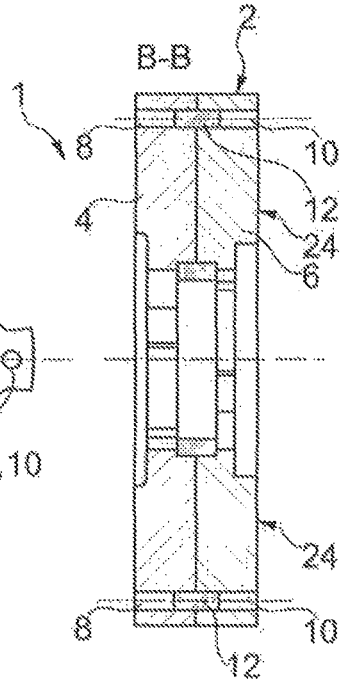

FIG. 2A shows a top view, and FIG. 2B shows a sectional view along the line B-B from FIG. 2B, of another embodiment of the hydraulic camshaft adjuster 1 according to the present disclosure, having an at least two-piece rotor 2.

In this case, the first rotor element 4 and the second rotor element 6 of the rotor 2 have numerous blades 24, each of which have formed four first bore-holes 8 or four second bore-holes 10, respectively, and in each case, a joinable connecting element 12 extends from the first bore-hole 8 into the second bore-hole 10. It is also conceivable here, however, that the first rotor element 4 is connected to the second rotor element 6 by means of more or fewer than four connecting elements 12 in the blades 24.

Figure 3A:
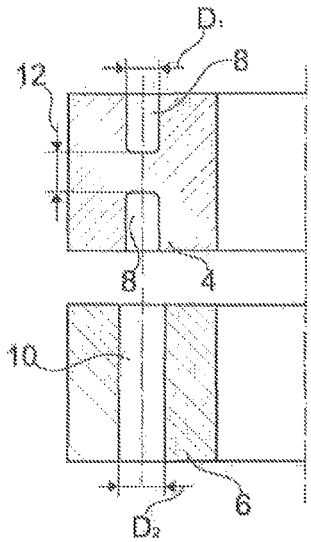
FIGS. 3A to 3C show simplified sectional views for illustrating individual steps of the method according to the present disclosure, for a joining of an at least two-piece rotor for a hydraulic camshaft adjuster.
Figure 3B:
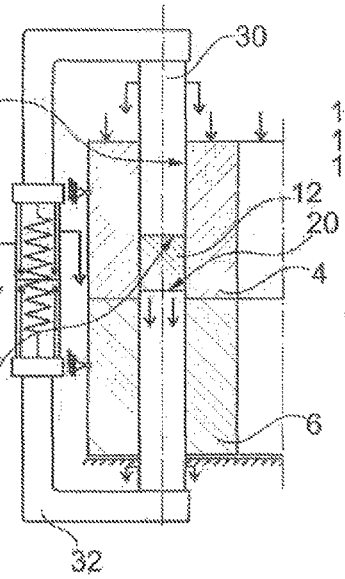
Figure 3C:
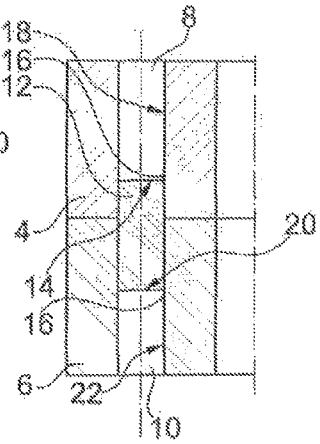

FIGS. 3A to 3C show simplified sectional views for illustrating individual steps of the method according to the present disclosure, for joining an at least two-piece rotor 2 for a hydraulic camshaft adjuster 1. The basis for the at least two-piece rotor 2 is formed by a first rotor element 4 and a second rotor element 6. In a first step, as is shown in FIG. 3A, at least a first bore-hole 8 in a first rotor element 4 and at least a second bore-hole 10 in the second rotor element 6 are formed by means of sintering technology, or drilled. A diameter D2 of the at least second bore-hole 10 is the same as, or slightly smaller than, a diameter D1 of the at least first bore-hole 8. The nominal diameters D1, D2 are 2.0 to 5 mm in one embodiment.

In a subsequent step, likewise shown in FIG. 3A, a connecting element 12 is formed in the middle 38 of the at least first bore-hole 8. In another embodiment of the present disclosure, however, it is also conceivable that the connecting element 12 is formed at an end of the at least first bore-hole 8. If a connecting element 12, as shown here, is formed in the middle 28 of the bore-hole, then the first rotor element 4 has two separate, opposing, coaxial blind bore-holes. The joinable connecting element 12 may be obtained by means of compression technology or sintering technology, such that a powder column or a sintering core 12 is pressed into, or sintered in the at least one first bore-hole 8.

Another step, depicted in FIG. 3B, provides that the first rotor element 4 and the second rotor element 6 are placed on one another such that the at least first bore-hole 8 is aligned with the at least second bore-hole 10. Subsequently, the joinable connecting element 12 is axially sheared off from a bore-hole wall 18 of the at least first bore-hole 8 by means of the pressing element 30, such that the joinable connecting element 12 is joined at least partially in the at least second bore-hole 10. The joining of the joinable connecting element 12 occurs here, as depicted, using a pressing mandrel 30 as the pressing element.

Optionally, as shown here in FIG. 3B by way of example, in one embodiment a first free end 14 and a second free end 20 of the joinable connecting element 12 are clamped by means of a compression device 32, and then sheared off by means of the pressing element 30, such that a better separation of the joinable connecting element 12 from the bore-hole wall 18 is obtained.

As shown in FIG. 3C, the joinable connecting element 12 can be inserted halfway, in terms of its axial length, into the at least second bore-hole 10, i.e. the connecting element 12 is located in the middle, between the at least first rotor element 4 and second rotor element 6. Furthermore, another embodiment can optionally provide that the first free end 14 of the joinable connecting element 12 is secured in place on the bore-hole wall 18 of the at least first bore hole 8 by means of laser-welded seams 16, and/or a second free end 20 of the joinable connecting element 12 is secured in place on a bore-hole wall 22 of the at least second bore-hole 10 by means of laser-welded seams 16.

Figure 4A:
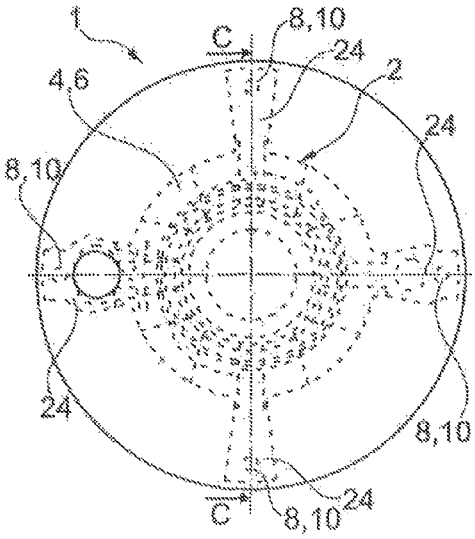
FIGS. 4A to 4F show a top view of an at least two-piece rotor and sectional views (along the line C-C from FIG. 4A) of the individual steps according to the present disclosure for a joining of the at least two-piece rotor.

FIG. 4A shows a top view of an at least two-piece rotor 2 and FIGS. 4B to 4F show sectional views (along the line C-C from FIG. 4A) of the individual steps according to the present disclosure, for joining the at least two-piece rotor 2.

Figure 4B:
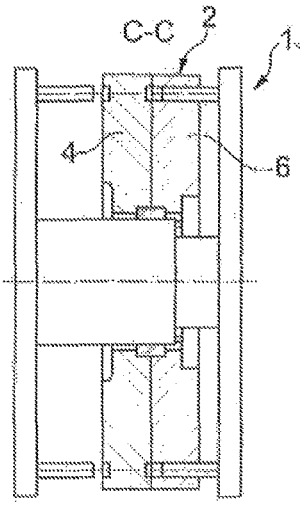
Figure 4C:
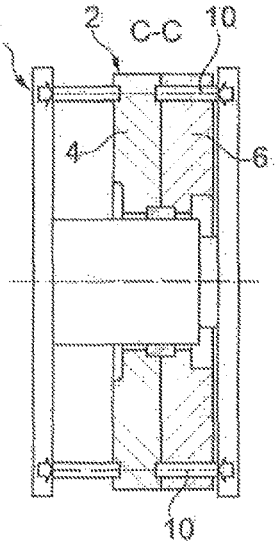
Figure 4F:
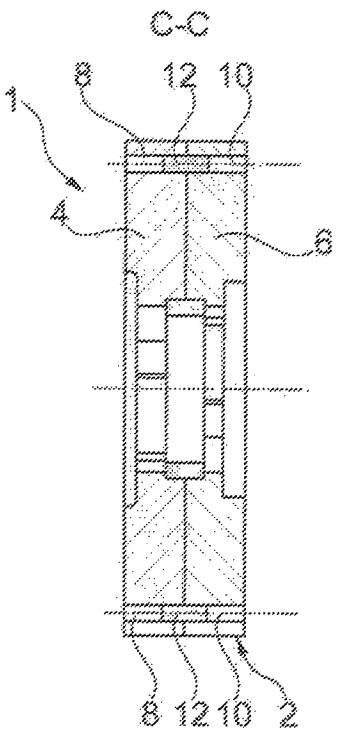
Figure 4E:
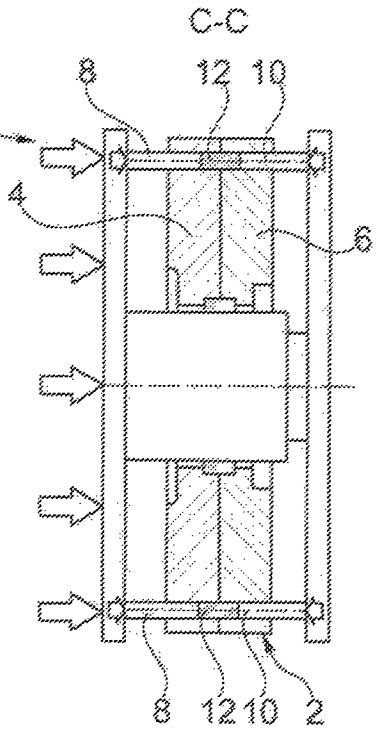
Figure 4D:
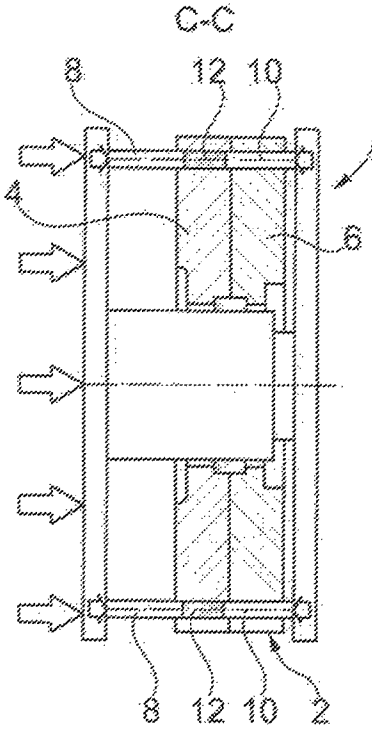

The starting position is shown in FIG. 4B and FIG. 4C. In FIG. 4D, the joinable connecting element in the form of a powder column or a sintering core 12 is pressed into or sintered in the at least first bore-hole 8. Subsequently, the joined powder column or the sintering core 12 is partially inserted into the at least second bore-hole 10 in a longitudinal press-fit. This is shown in FIG. 4E. The connection of the two rotor elements 4, 6 by means of the joined powder column or the joined sintering core 12 is depicted in FIG. 4F.

Because the reference symbols depicted in FIGS. 4A to 4F have already been explained in reference to FIGS. 1 to 3C, there shall be no further explanation thereof at this point.

REFERENCE SYMBOLS

1 hydraulic camshaft adjuster
2 rotor
4 first rotor element
6 second rotor element
8 first bore-hole
10 second bore-hole
12 joinable connecting element, powder column, sintering core
14 first free end
16 laser-welded seam
18 bore-hole wall of the first bore-hole
20 second free end
22 bore-hole wall of the second bore-hole
24 blade
28 middle of the first bore-hole
30 pressure element
32 compression device
A axis
D1 diameter of the first bore-hole
D2 diameter of the second bore-hole

The invention claimed is:

1. A hydraulic camshaft adjuster comprising:

an at least two-piece rotor rotatable about an axis and having a first rotor element and a second rotor element, wherein the first rotor element has at least a first bore-hole aligned with at least a second bore-hole of the second rotor element, wherein a joinable connecting element is located in both the at least one first bore-hole and the at least second bore-hole such that the first rotor element is joined to the second rotor element in a form-fitting, force-fitting or material bonded manner, wherein the joinable connecting element extends only partially through the first and second rotor elements.

2. The hydraulic camshaft adjuster according to claim 1, wherein a first free end of the joinable connecting element is secured in place by means of a sintering technology connection or laser-welded seams to a bore-hole wall of the at least first bore-hole and/or a second free end of the joinable connecting element is secured in place by means of a sintering technology connection or laser-welded seams on a bore-hole wall of the at least second bore-hole.

3. The hydraulic camshaft adjuster according to claim 1, wherein the joinable connecting device is a powder column or a sintering core.

4. The hydraulic camshaft adjuster according to claim 1, wherein the first rotor element and the second rotor element of the at least two-piece rotor have numerous blades, in which, respectively, the at least first bore-hole, or the at least second bore-hole, has been formed, and in each case, a joinable connecting element extends from the first bore-hole into the second bore-hole.

5. The hydraulic camshaft adjuster according to claim 1, wherein the joinable connecting element is a powder column or a sintering core pressed into and/or sintered in the at least first bore-hole.

6. The hydraulic camshaft adjuster according to claim 5, wherein a diameter of the at least second bore-hole is the same size as, or slightly smaller than, a diameter of the at least first bore-hole.

7. A method for producing of a rotor for a hydraulic camshaft adjuster, comprising:

sintering or drilling a first bore-hole in a first rotor element and a second bore-hole in a second rotor element, wherein a diameter of the second bore-hole is the same size as, or slightly smaller than, a diameter of the first bore-hole;

forming a joinable connecting element at an end, or in the middle of, the first bore-hole;

placing the first rotor element on the second rotor element, such that the first bore-hole is aligned with the second bore-hole;

axially shearing off of the joinable connecting element from a bore-hole wall of the first bore-hole via a pressing element, such that the joinable connecting element is at least partially inserted into the second bore-hole and wherein the joinable connecting element extends only partially through the first and second rotor elements; and sintering and calibrating the joined rotor.

8. The method according to claim 7, wherein the formation of the joinable connecting element is carried out via compression technology or sintering technology, such that a powder column or a sintering core is pressed into and/or sintered in the first bore-hole.

9. The method according to claim 7, wherein a first free end and a second free end of the joinable connecting device is clamped via a compression device, and then axially sheared off by means of the pressing element.

10. The method according to one of the claim 7, wherein the first free end of the joinable connecting element is secured in place on the bore-hole wall of the at least first bore-hole via a sintering connection or laser-welded seams, and the second free end of the joinable connecting element is secured in place on a bore-hole wall of the second bore via a sintering connection or laser-welded seams.

11. A method of manufacturing a rotor of a hydraulic camshaft adjuster, comprising:

forming a first bore-hole into a first rotor element, wherein the first bore-hole extends along an axis from a first surface of the first rotor element and partially toward a second surface of the first rotor element such that material of the first rotor element exists between the first bore-hole and the second surface;

forming a second bore-hole into a second rotor element;

aligning the first bore-hole with the second bore-hole;

pressing the material along the axis toward the second bore-hole to shear the material and form a connecting element that is disposed within the first rotor element and the second rotor element wherein the connecting element extends only partially through the first and second rotor elements.

12. The method of claim 11, wherein a diameter of the first bore-hole exceeds a diameter of the second bore-hole.

13. The method of claim 11, wherein the step of forming the first bore-hole includes sintering the first bore-hole, and the step of forming the second bore-hole includes sintering the second bore-hole.

14. The method of claim 11, wherein the step of pressing locates the connecting element within the second bore-hole.

* * * * *